US009194586B2

(12) United States Patent
Hawie et al.

(10) Patent No.: US 9,194,586 B2
(45) Date of Patent: Nov. 24, 2015

(54) TWO-STAGE COMBUSTOR FOR GAS TURBINE ENGINE

(75) Inventors: Eduardo Hawie, Woodbridge (CA); Nigel Davenport, Hillsburgh (CA)

(73) Assignee: PRATT & WHITNEY CANADA CORP., Longueuil, Quebec (CA)

( * ) Notice: Subject to any disclaimer, the term of this patent is extended or adjusted under 35 U.S.C. 154(b) by 575 days.

(21) Appl. No.: 13/313,344

(22) Filed: Dec. 7, 2011

(65) Prior Publication Data

US 2013/0145767 A1 Jun. 13, 2013

(51) Int. Cl.

| | |
|---|---|
| ***F02C 1/00*** | (2006.01) |
| ***F23R 3/16*** | (2006.01) |
| ***F23R 3/34*** | (2006.01) |
| ***F23R 3/44*** | (2006.01) |
| *F23C 6/02* | (2006.01) |
| *F23R 3/50* | (2006.01) |

(52) U.S. Cl.

CPC . *F23R 3/16* (2013.01); *F23R 3/346* (2013.01); *F23R 3/44* (2013.01); *F23C 6/02* (2013.01); *F23R 3/50* (2013.01)

(58) Field of Classification Search

CPC ..... F23R 3/34; F23R 3/286; F23R 3/58; F23R 3/346; F23R 6/047; F23R 6/00; F23R 6/02; F23R 3/50

USPC ..... 60/733, 737, 748, 746, 739, 804

See application file for complete search history.

(56) References Cited

U.S. PATENT DOCUMENTS

| | | | | |
|---|---|---|---|---|
| 3,811,277 | A * | 5/1974 | Markowski | 60/733 |
| 3,872,664 | A | 3/1975 | Lohmann et al. | |
| 3,937,008 | A | 2/1976 | Markowski et al. | |
| 3,973,390 | A * | 8/1976 | Jeroszko | 60/776 |
| 4,045,956 | A | 9/1977 | Markowski et al. | |
| 4,058,977 | A | 11/1977 | Markowski et al. | |
| 4,168,609 | A * | 9/1979 | Greenberg et al. | 60/804 |
| 4,246,758 | A | 1/1981 | Caruel et al. | |
| 4,470,262 | A | 9/1984 | Shekleton | |
| 4,903,492 | A * | 2/1990 | King | 60/733 |
| 5,207,064 | A * | 5/1993 | Ciokajlo et al. | 60/737 |
| 5,261,239 | A * | 11/1993 | Barbier et al. | 60/731 |
| 5,285,635 | A | 2/1994 | Savelli et al. | |
| 5,289,687 | A | 3/1994 | Kress et al. | |
| 5,295,354 | A | 3/1994 | Barbier et al. | |
| 5,311,743 | A | 5/1994 | Ansart et al. | |
| 5,331,814 | A * | 7/1994 | Sandelis | 60/747 |
| 5,490,380 | A | 2/1996 | Marshall | |
| 5,653,109 | A | 8/1997 | Overton et al. | |
| 5,746,048 | A * | 5/1998 | Shah | 60/776 |
| 5,816,050 | A | 10/1998 | Sjunnesson et al. | |
| 5,862,668 | A | 1/1999 | Richardson | |
| 6,058,710 | A | 5/2000 | Brehm | |
| 6,405,523 | B1 | 6/2002 | Foust et al. | |
| 6,481,209 | B1 | 11/2002 | Johnson et al. | |
| 6,968,699 | B2 | 11/2005 | Howell et al. | |
| 7,055,331 | B2 | 6/2006 | Graf et al. | |
| 7,506,511 | B2 | 3/2009 | Zupanc et al. | |

(Continued)

*Primary Examiner* — Gerald L Sung

(74) *Attorney, Agent, or Firm* — Norton Rose Fulbright Canada LLP

(57) ABSTRACT

A combustor for a gas turbine engine comprises an inner annular liner and an outer annular liner. First and second combustion stages are defined between the liners. Each combustion stage has a plurality of fuel injection bores distributed in a liner wall defining the respective stage. A lobed mixer extends into the combustor, the lobed mixer arranged to receive combustion gases from each combustion stage for mixing flows of said combustion gases.

18 Claims, 4 Drawing Sheets

(56) References Cited

U.S. PATENT DOCUMENTS

| | | | | |
|---|---|---|---|---|
| 7,716,931 | B2 | 5/2010 | Mancini et al. | |
| 7,966,821 | B2 | 6/2011 | Zupanc et al. | |
| 2004/0055307 | A1* | 3/2004 | Knoepfel | 60/737 |
| 2011/0185735 | A1 | 8/2011 | Snyder | |

* cited by examiner

TWO-STAGE COMBUSTOR FOR GAS TURBINE ENGINE

TECHNICAL FIELD

The application relates generally to gas turbine engines and, more particularly, to two-stage combustors.

BACKGROUND OF THE ART

In two-stage combustors, the combustor is comprised of two sub-chambers, one for the pilot stage of the burner, and the other for the main stage of the burner. The pilot stage operates the engine at low power settings, and is kept running at all conditions. The pilot stage is also used for operability of the engine to prevent flame extinction. The main stage is additionally operated at medium- and high-power settings. The arrangement of two-stage combustors involves typically complex paths, and may make avoiding dynamic ranges with their increased-complexity geometry more difficult. Also, problems may occur in trying to achieve a proper temperature profile. Finally, durability has been problematic.

SUMMARY

In one aspect, there is provided a combustor for a gas turbine engine comprising: an inner annular liner; an outer annular liner; first and second combustion stages defined between the liners, each said combustion stage having a plurality of fuel injection bores distributed in a liner wall defining the respective stage; and a lobed mixer extending into the combustor, the lobed mixer arranged to receive combustion gases from each combustion stage for mixing flows of said combustion gases.

In a second aspect, there is provided a gas turbine engine comprising: a casing defining a plenum; a combustor within the plenum and comprising: an inner annular liner; an outer annular liner; first and second combustion stages defined between the liners, each said combustion stage having a plurality of fuel injection bores distributed in a liner wall defining the respective stage; and a lobed mixer extending into the combustor, the lobed mixer arranged to receive combustion gases from each combustion stage for mixing flows of said combustion gases; a diffuser having outlets communicating with the plenum; and injectors and/or valves at the injection bores.

Further details of these and other aspects of the present invention will be apparent from the detailed description and figures included below.

DESCRIPTION OF THE DRAWINGS

Reference is now made to the accompanying figures, in which.

DETAILED DESCRIPTION OF EMBODIMENTS

Figure 1:
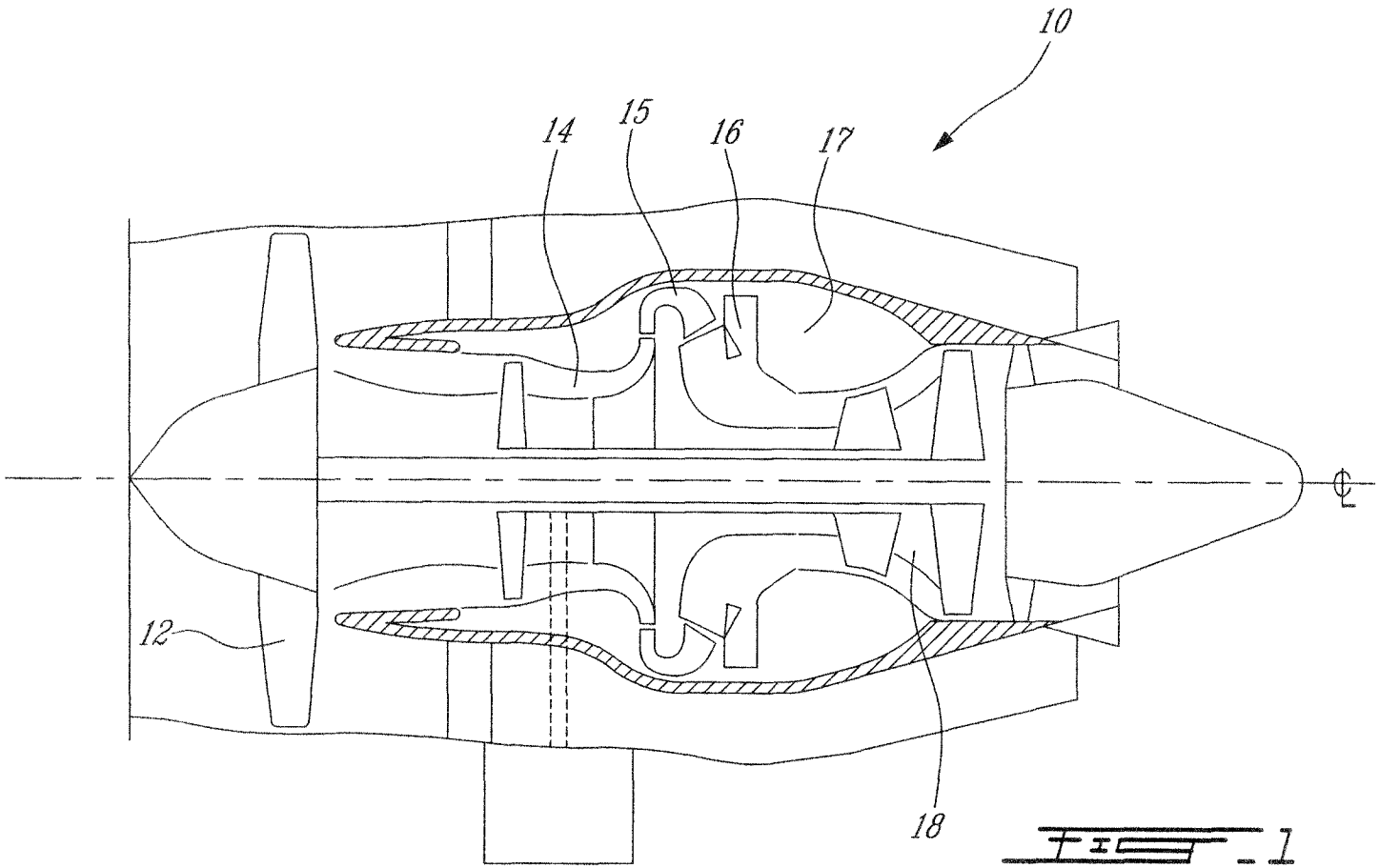
FIG. 1 is a schematic cross-sectional view of a turbofan gas turbine engine with a two-stage combustor in accordance with the present disclosure.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a plurality of curved radial diffuser pipes 15 in this example, a combustor 16 in which the compressed air is mixed with fuel and ignited for generating an annular stream of hot combustion gases, a plenum 17 defined by the casing and receiving the radial diffuser pipes 15 and the combustor 16, and a turbine section 18 for extracting energy from the combustion gases. The combustor 16 is a two-stage combustor in accordance with the present disclosure.

Figure 2:
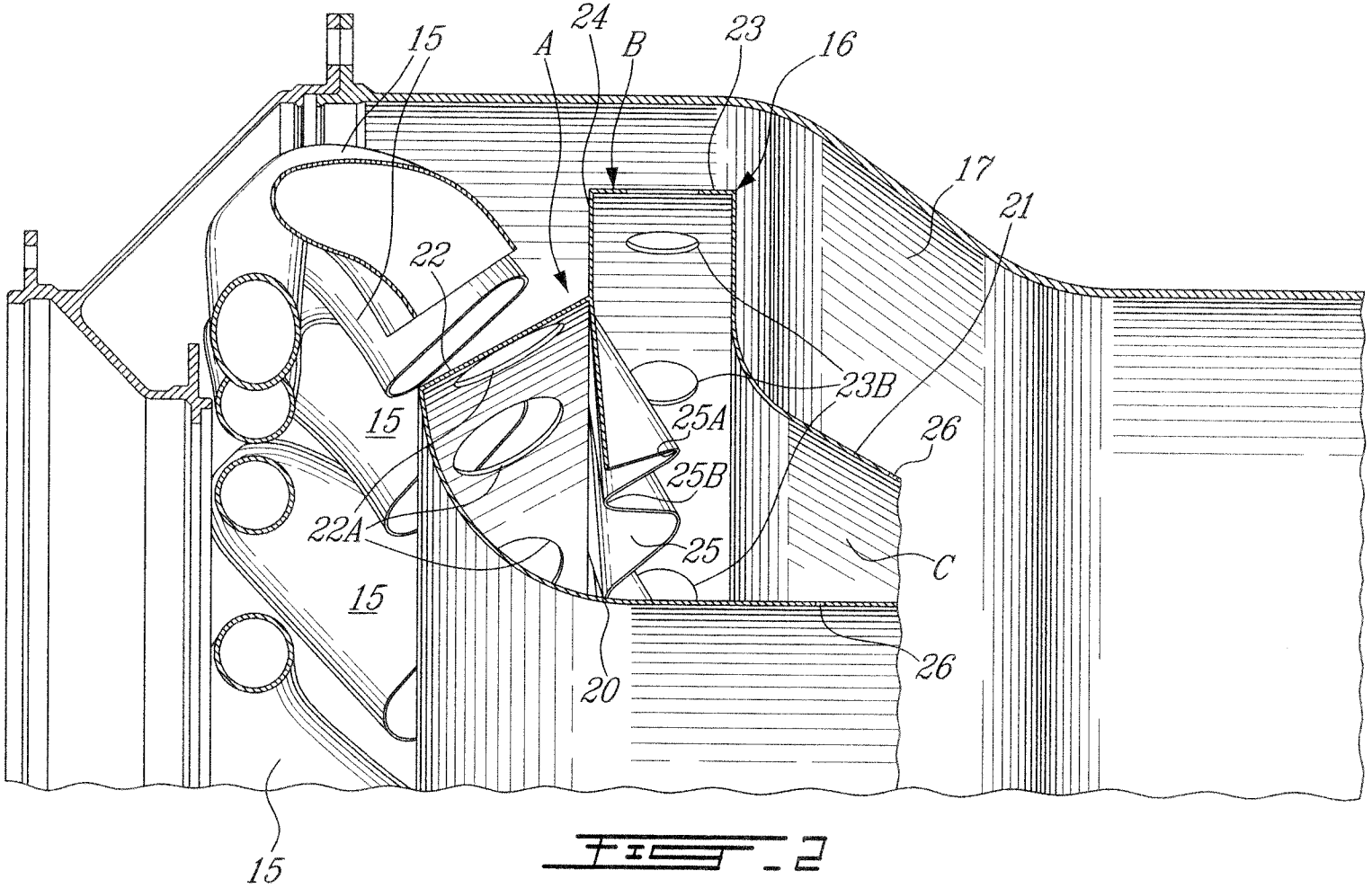
FIG. 2 is an enlarged sectional view, fragmented, of the two-stage combustor of the present disclosure.

Referring to FIG. 2, the combustor 16 of the present disclosure is shown in greater detail. The combustor 16 has an annular geometry, with an inner liner wall 20, and an outer liner wall 21 concurrently defining the combustion chamber therebetween. The inner liner wall 20 has a fore end oriented generally radially relative to the engine centerline, with the inner liner wall 20 curving into an axial orientation relative to the engine centerline. Likewise, the outer liner wall 21 has a fore end oriented generally radially relative to the engine centerline, with the outer liner wall 21 curving into an oblique orientation relative to the engine centerline.

A dome interrelates the inner liner wall 20 to the outer liner wall 21. The dome is the interface between air/fuel injection components and a combustion chamber. The dome has a first end wall 22 (i.e., dome wall) sharing an edge with the inner liner wall 20. The first end wall 22 may be in a non-parallel orientation relative to the engine centerline. Injection bores 22A are circumferentially distributed in the first end wall 22.

A second end wall 23 (i.e., dome wall) of the dome shares an edge with the outer liner wall 21. The second end wall 23 may be in a generally parallel orientation relative to the engine centerline, or in any other suitable orientation. Injection bores 23B are circumferentially distributed in the first end wall 23. In the illustrated embodiment, the first end wall 22 may be wider than the second end wall 23.

An intermediate wall 24 of the dome may join the first end wall 22 and the second end wall 23, with the second end wall 23 being positioned radially farther than the first end wall 22 (by having a larger radius of curvature than that of the first end wall 22 relative to the engine centerline). The intermediate wall 24 may be normally oriented relative to the engine centerline. In this example, mixing features extend into the combustion chamber from the dome walls. The mixing features may be a mixer wall 25 extending from the intermediate wall 24 and projects into an inner cavity of the combustor 16. The mixer wall 25 may have a lobed annular pattern, as illustrated in FIG. 2, with a succession of peaks and valleys along a circumference of the mixer wall 25. The lobed mixer wall 25 in between the stages can be made out of composite materials (e.g. CMC) or metal. Although not shown, the lobed mixer wall 25 may be cooled by conventional methods (i.e., louvers, effusion and/or back side cooling).

Figure 3:
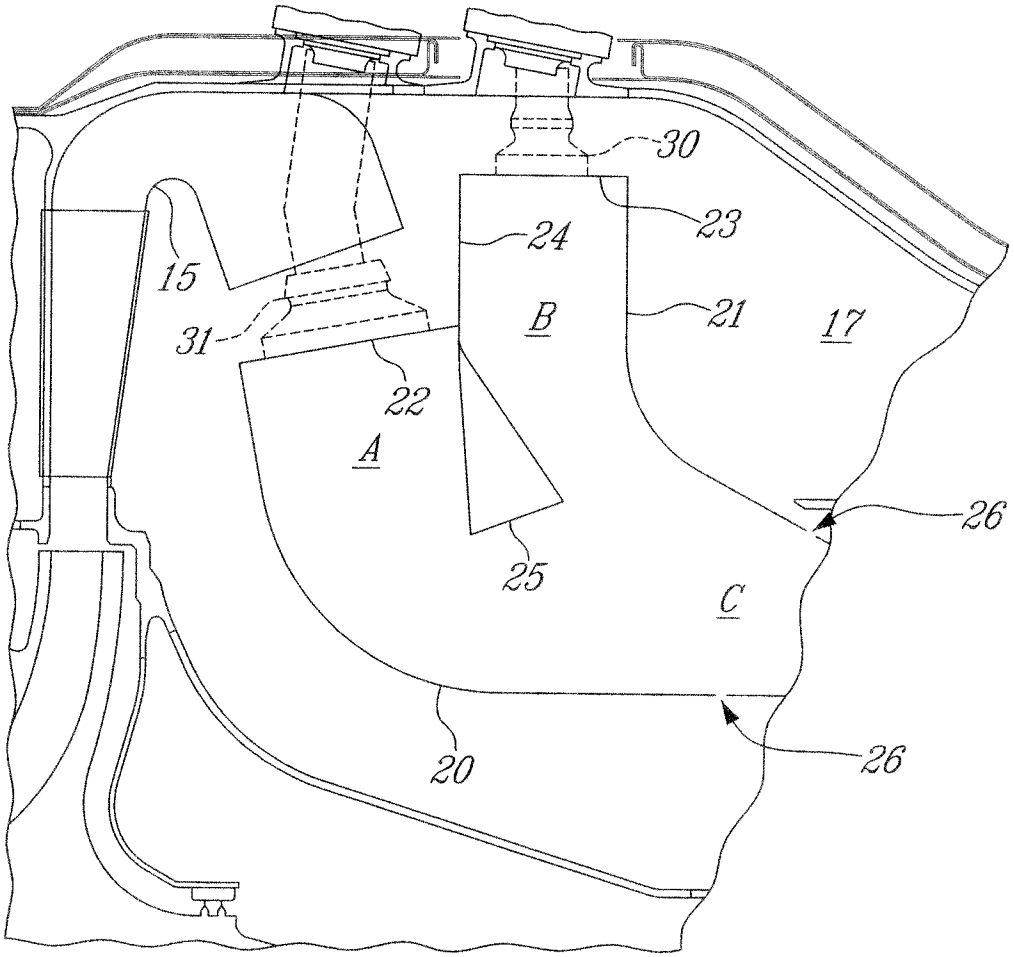
FIG. 3 is a schematic view of the two-stage combustor of FIG. 2, with diffusers and staging valves.

Accordingly, as shown in FIGS. 2 and 3, the combustor 16 comprises a pair of annular portions, namely A and B, merging into an aft portion C of the combustor 16. The annular portion A is defined by the inner liner wall 20, the first end wall 22 and a fore surface of the mixer wall 25. The annular portion B is defined by the outer liner wall 21, the second end wall 23, the intermediate wall 24, and an aft surface of the mixer wall 25. Dilution ports 26 may be defined in the liners of the aft portion C, to trim the radial profile of the combustion products.

Either one of the annular portions A and B may be used for the pilot stage, while the other of the annular portions A and B may be used for the main combustion stage. Referring to FIG. 3, as an example, the annular portion B is used for the pilot stage. In this example, the main combustion stage, represented by the annular portion A, has a larger volume than the pilot stage. Moreover, in this example, the main combustion stage is entirely axially forward of the second combustion stage.

Accordingly, injectors 30 are schematically illustrated as being mounted to the combustor outer case and as floating on the annular portion B, in register with respective floating collars at injection bores 23B, for the feed of plenum air and fuel to the annular portion B of the combustor 16. The annular portion A is used as the main stage in the case of having only fuel staging. The injectors 31 for annular portion A may have the same attachment arrangement as the injectors for the annular portion B. In the case of air staging, the annular portion A could act as the pilot section if it is considered convenient. Staging valves can be located in either location and, at the same time, they can act as support for the combustor, as well as acting as staging valves and fuel nozzle/swirlers.

Figure 5:
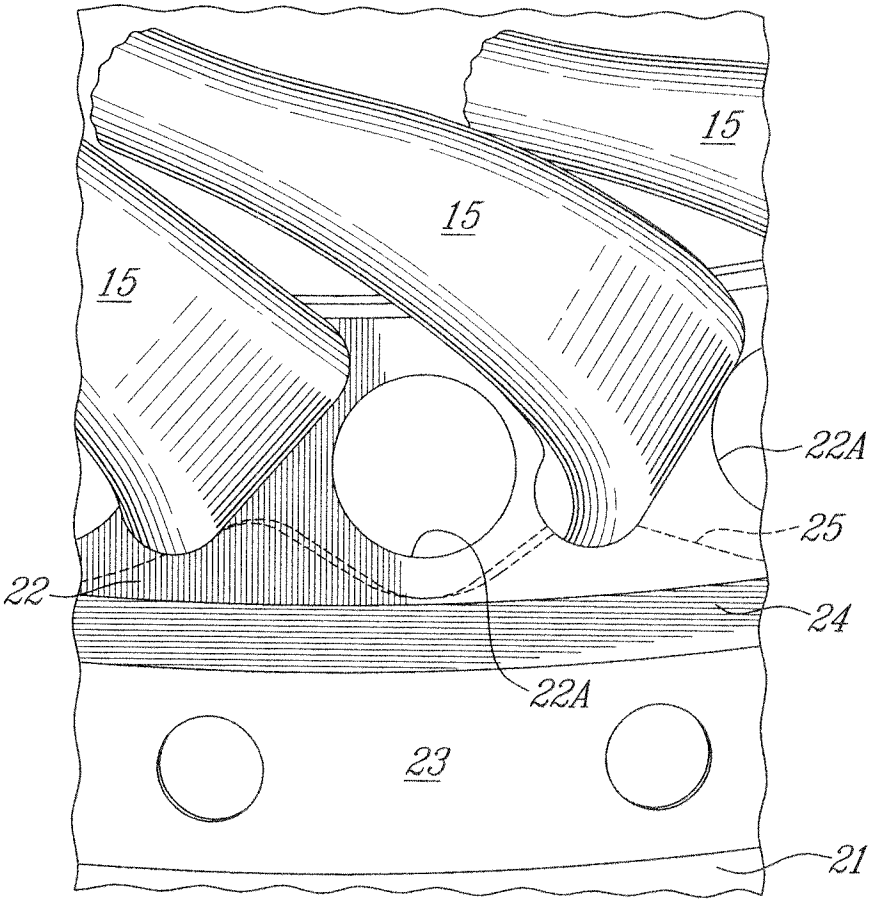
FIG. 5 is an enlarged perspective view of end walls of the two-stage combustor, showing an arrangement between a lobed mixer wall and fore injection ports.
Figure 4:
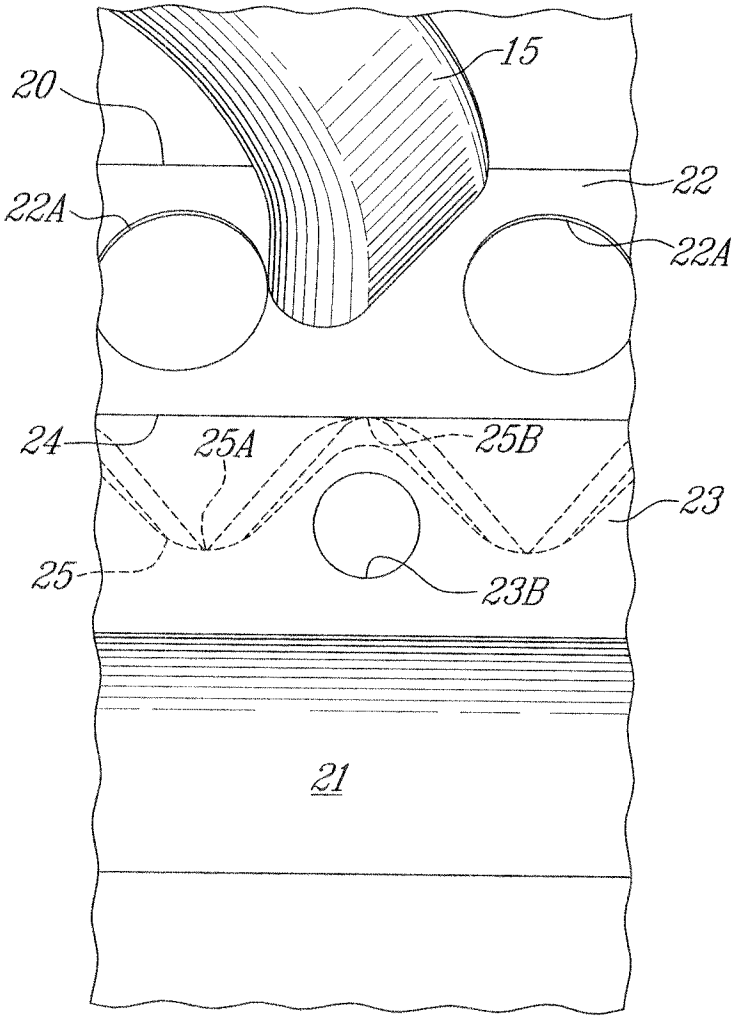
FIG. 4 is an enlarged perspective view of end walls of the two-stage combustor, showing an arrangement between a lobed mixer wall and aft injection ports.

Referring to FIG. 4, the injection bores 23B of the annular portion B (with injectors 30 removed for illustration purposes) are shown as being in radial register with valleys of the lobed mixer wall 25. Referring to FIG. 5, the injection bores 22A of the annular portion A (with staging valves/injectors 31 removed for illustration purposes) are shown as being in radial register with valleys of the lobed mixer wall 25. Therefore, the injection bores 22A and 23B are circumferentially offset from one another, as shown in FIGS. 4 and 5. As shown in FIGS. 2 and 3, the injection bores are also radially offset from one another by reason of the larger radius of the second end wall 23. Moreover, as shown in both FIGS. 4 and 5, ends of passages of the diffuser pipes 15 are located between the injection bores 22A (i.e., in circumferential offset), but in circumferential alignment with the bores 23B. Therefore, there is a clearance opposite the injection bores 22A, thus defining a volume for the installation and presence of injectors or staging valves.

Referring to FIG. 2, bottom edges 25A of each of the valleys of the mixer wall 25 in the annular portion A are approximately normal to the first end wall 22, at intersections therebetween. Likewise, bottom edges of each of the valleys of the mixer wall 25B are approximately normal to the second end wall 23, at intersections therebetween. In both cases, other orientations between valleys and end walls are also possible.

The arrangement of the combustor 16 may be well suited for engines with centrifugal compressors, and may be used for fuel and/or air staging since the front end of the combustor may be readily accessible and close to the outer case. This could enable the use of actuators for controlling air splits or flow splits on the outside of the combustor chamber, since the mechanisms can be placed outside the plenum 17.

The above description is meant to be exemplary only, and one skilled in the art will recognize that changes may be made to the embodiments described without departing from the scope of the invention disclosed. Any suitable liner configurations and dome shapes may be employed. The intermediate wall may have any suitable configuration, and need not be a lobed mixer but may have other mixing features or no mixing function at all. The fuel nozzles may be of any suitable type and provided in any suitable orientation. The fuel nozzles may be fed from common stems or from a common source. Any suitable diffuser arrangement may be used, and pipe type diffusers are not required nor is the radial arrangement depicted in the above examples. For example, a vane diffuser may be provided in preference to a pipe diffuser. Where axial compression is provided, another suitable arrangement for diffusion may be provided. The combustor liner and stage arrangement may be any suitable arrangement and need not be limited to the arrangement described in the examples above. Still other modifications which fall within the scope of the present invention will be apparent to those skilled in the art, in light of a review of this disclosure, and such modifications are intended to fall within the appended claims.

What is claimed is:

1. A combustor for a gas turbine engine comprising:

liner walls circumscribing combustion stages, the liner walls forming at least an inner annular liner, an outer annular liner and dome portions;

first and second combustion stages defined between the liners and dome portions and in a parallel arrangement relative to one another, each said combustion stage having a plurality of fuel injection bores formed into and circumferentially distributed in said dome portions defining the respective stage; and a lobed mixer extending into the combustor and located between the first combustion stage and the second combustion stage, the lobed mixer arranged to receive combustion gases from each combustion stage for mixing flows of said combustion gases.

2. The combustor according to claim 1, wherein the first and second stages extend generally radially inwardly, and wherein the lobed mixer extends generally radially inwardly intermediate the two stages.

3. The combustor according to claim 1, wherein the lobed mixer is disposed entirely within the combustor and between the inner annular liner and the outer annular liner.

4. The combustor according to claim 1, wherein the liner walls include an intermediate wall separating the first combustion stage from the second combustion stage, and wherein the lobed mixer extends from the intermediate wall into the combustor.

5. The combustor according to claim 1, wherein valleys of the lobed mixer wall are in circumferential register with the injection bores of one of said combustion stages, while the peaks of the lobed mixer are in circumferential register with the injection bores of the other said combustion stage.

6. The combustor according to claim 1, wherein the inner annular liner wall has an axially forward end generally radially oriented, the inner annular liner wall curving into an axial orientation in an aft direction.

7. The combustor according to claim 1, wherein the outer annular liner wall has an axially forward end generally radially oriented, the outer annular liner wall curving into an axial orientation in an aft direction.

8. The combustor according to claim 1, wherein the dome portions include a first dome wall and a second dome wall, the first combustion stage being defined by the inner annular liner, the first dome wall and the lobed mixer, the second combustion stage being defined by the outer annular liner, the second dome wall and the lobed mixer.

9. The combustor according to claim 8, wherein edges of valleys of the lobed mixer wall are generally normal to a plane of their respective one of the first dome wall and second dome wall.

10. A gas turbine engine comprising:

a casing defining a plenum;

a combustor within the plenum and comprising:

liner walls circumscribing combustion stages, the liner walls forming at least an inner annular liner, an outer annular liner and dome portions;

first and second combustion stages defined between the liners and in a parallel arrangement relative to one another, each said combustion stage having a plurality of fuel injection bores formed into and circumferentially distributed in said dome portions defining the respective stage; and a lobed mixer extending into the combustor and located between the first combustion stage and the second combustion stage, the lobed mixer arranged to receive combustion gases from each combustion stage for mixing flows of said combustion gases;

a diffuser having outlets communicating with the plenum; and injectors and/or valves at the injection bores.

11. The gas turbine engine according to claim 10, wherein the first and second stages extend generally radially inwardly, and wherein the lobed mixer extends generally radially inwardly intermediate the two stages.

12. The gas turbine engine according to claim 10, wherein the lobed mixer is disposed entirely within the combustor and between the inner annular liner and the outer annular liner.

13. The gas turbine engine according to claim 10, wherein the liner walls include an intermediate wall separating the first combustion stage from the second combustion stage, and wherein the lobed mixer extends from the intermediate wall into the combustor.

14. The gas turbine engine according to claim 10, wherein valleys of the lobed mixer wall are in circumferential register with the injection bores of one of said combustion stages, while the peaks of the lobed mixer are in circumferential register with the injection bores of the other said combustion stage.

15. The gas turbine engine according to claim 10, wherein the inner annular liner wall having an axially forward end generally radially oriented, the inner annular liner wall curving into an axial orientation in an aft direction.

16. The gas turbine engine according to claim 10, wherein the dome portions include a first dome wall and a second dome wall, the first combustion stage being defined by the inner annular liner, the first dome wall and the lobed mixer, the second combustion stage being defined by the outer annular liner, the second dome wall and the lobed mixer.

17. The gas turbine engine according to claim 16, wherein edges of valleys of the lobed mixer are generally normal to a plane of their respective one of the first dome wall and second dome wall.

18. The gas turbine engine according to claim 10, wherein the diffuser outlets are circumferentially distributed about the combustor, with the outlets of the diffuser being offset from the injection bores of the first stage.

* * * * *